US005937811A

United States Patent [19]

Motosugi et al.

[11] Patent Number: 5,937,811

[45] Date of Patent: Aug. 17, 1999

[54] VARIABLE VALVE SYSTEM

[75] Inventors: Katsuhiko Motosugi, Toyota; Kiyoharu Tsuda, Anjo, both of Japan

[73] Assignee: Otics Corporation, Aichi, Japan

[21] Appl. No.: 08/978,578

[22] Filed: Nov. 26, 1997

[30] Foreign Application Priority Data

Apr. 18, 1997 [JP] Japan ..... 9-116162

[51] Int. Cl.[6] ..... F01L 1/34; F01L 13/00

[52] U.S. Cl. ..... 123/90.18; 123/90.45

[58] Field of Search ..... 123/90.15, 90.17, 123/90.18, 90.39, 90.41, 90.42, 90.44, 90.45, 90.5, 90.52, 90.6

[56] References Cited

U.S. PATENT DOCUMENTS 4,773,359 9/1988 Titolo ..... 123/90.22

FOREIGN PATENT DOCUMENTS 62-9707 1/1987 Japan .

2-271014 11/1990 Japan .

9-21305 1/1994 Japan .

*Primary Examiner*—Weilun Lo

*Attorney, Agent, or Firm*—Pillsbury Madison & Sutro LLP

[57] ABSTRACT

A variable valve system according to the present invention comprises a solid cam having a cam profile continuously varying in axial direction of a cam shaft in a range from lower revolutions to higher revolutions of an internal combustion engine, a displacement device for axially displacing the solid cam continuously or stepwise, and an arm that swings in accordance with the cam profile of the solid cam to open and close a valve. The arm is provided with a cam contacting mechanism that is formed of a seat and a cam contacting portion. The cam contacting portion is fitted into the seat such that the cam contacting portion contacts the solid cam and follows changes in inclination of a tangential line defined by the cam contacting portion and the solid cam when the solid cam rotates.

18 Claims, 12 Drawing Sheets

VARIABLE VALVE SYSTEM

BACKGROUND OF THE INVENTION

1. Field of the Invention

The present invention relates to a variable valve system for changing valve timing and lift amount continuously or stepwise in a range from lower revolutions to higher revolutions of an internal combustion engine.

2. Description of the Related Art

Conventionally, a variety of valve systems have been disclosed for changing the valve timing (including valve opening angle and phase) and lift amount in two steps between lower revolutions and higher revolutions of the internal combustion engine.

For example, one of such variable valve systems is provided with a swing arm that is caused to swing selectively by either a cam for lower revolutions or a cam for higher revolutions. The cam for lower revolutions opens and closes an intake or exhaust valve at smaller valve opening angles with smaller lift amounts, whereas the cam for higher revolutions opens and closes the valve at larger valve opening angles with larger lift amounts. FIG. 18 shows a relationship between valve timing and lift amount with regard to the intake (right) and exhaust (left) valves of this system. For lower revolutions of the internal combustion engine, as indicated by a solid line of FIG. 18, the valve opening angles and lift amounts of the exhaust and intake valves are set to smaller values respectively in order to generate swirl in intake air. This results in an increase in torque for lower vehicle speeds as well as a substantial reduction in fuel consumption. For higher revolutions of the internal combustion engine, as indicated by a broken line of FIG. 18, the valve opening angles and lift amounts of the exhaust and intake valves are set to larger values respectively, which results in a substantial increase in intake air volume and high speed outputs.

Another variable valve system includes a displacement device with helical splines, into which a cam shaft for intake valves is spline-fitted. The cam shaft has cams for pressing valve lifters of a directly-hitting type. The displacement device rotates the cam shaft by a predetermined angle, thereby making a distinction between lower revolutions and higher revolutions. This system changes valve timing phase and leaves valve opening angle and lift amount unchanged. FIG. 19 shows a relationship between valve timing and lift amount with regard to the intake (right) and exhaust (left) valves of this system. For lower revolutions, as indicated by a solid line of FIG. 19, the valve timing phase of the intake valves is shifted towards that of the exhaust valves, increasing the amount of overlap between the intake and exhaust valves. Thereby the intake valves are closed at an earlier stage, which results in an increase in torque for lower vehicle speeds as well as a substantial reduction in fuel consumption. For higher revolutions, as indicated by a broken line of FIG. 19, the valve timing phase of the intake valves is shifted away from that of the exhaust valves, reducing the amount of overlap between the intake and exhaust valves. Thereby the time period during which intake air flows into the internal combustion engine is prolonged, which results in an increase in high speed outputs.

In comparison with a generally employed non-variable valve system, the aforementioned conventional variable valve systems significantly improve various characteristics including torque, outputs, fuel consumption and cleanliness of exhaust gas. A dashed line of FIG. 7 indicates the torque characteristics of internal combustion engines equipped with the conventional variable valve systems, whereas a broken line of FIG. 7 indicates the torque characteristics of an internal combustion engine equipped with the generally employed non-variable valve system. It is obvious that the torque level achieved by the former is well above that achieved by the latter over the entire revolution range. Although there may be a slight difference depending on respective setting conditions, it is considered that the conventional variable valve systems can reduce fuel consumption by a maximum of 8 to 10%.

However, the conventional variable valve systems have the following drawbacks.

(1) The conventional variable valve systems both change valve timing or lift amount only in two steps between lower revolutions and higher revolutions. It is therefore difficult to execute control precisely depending on various operating conditions of the internal combustion engine. As indicated by the dashed line of FIG. 7, the torque characteristic curve may have a trough point between lower revolutions and higher revolutions. Such a trough point is likely to appear especially in those setting conditions which aim at improving the torque characteristics for higher revolutions, e.g., 8000 rpm.

(2) There may be a contradictory problem raised by changing only the valve timing phase with the valve opening angle and lift amount remaining unchanged. If the valve opening angle is set to a large value to improve outputs for higher revolutions, the torque for lower revolutions deteriorates, causing an unstable idling state. To the contrary, if the valve opening angle is set to a small value to improve the torque for lower revolutions, outputs for higher revolutions deteriorates.

(3) The contradictory problem as described above can be solved by selectively operating a cam for lower revolutions, which is used for smaller valve opening angles and lift amounts, and a cam for higher revolutions, which is used for larger valve opening angles and lift amounts. However, since it is necessary to provide one valve with two cams and two or three arms, the overall construction becomes complicated and less compact. In order to selectively operate the cams, there is generally employed a device for displacing a pin by applying a high hydraulic pressure thereto. However, such a device lacks precision and reliability, i.e., it is unable to witch the cams smoothly in a single operation cycle, causes noise when switching the cams, or partially wears out. In addition, a high hydraulic pressure source is required to quicken operational response in switching the cams.

SUMMARY OF THE INVENTION

It is thus an object of the present invention to provide a novel variable valve system that is capable of executing control precisely depending on operating conditions of an internal combustion engine by changing valve timing and lift amount continuously or stepwise in a range from lower revolution to higher revolutions of the internal combustion engine so that various characteristics including torque, outputs, fuel consumption and cleanliness of exhaust gas can be improved over the entire revolution range, capable of operating smoothly and quietly, and capable of realizing a simplified and compact construction wherein each valve is provided with one solid cam and one arm.

This object is attained by providing a variable valve system comprising a solid cam having a cam profile that continuously varies in axial direction over a range from lower revolutions to higher revolutions, a displacement device for axially displacing the solid cam continuously or stepwise, an arm for opening and closing a valve, the arm swinging in accordance with the cam profile of the solid cam, wherein the arm is provided with a cam contacting mechanism formed of a seat and a cam contacting element, and wherein the cam contacting element is fitted into the seat to slide on the seat such that the cam contacting element contacts the solid cam and follows changes in inclination of a tangential line defined by the cam contacting element and the solid cam when the solid cam rotates.

The valve timing phase, valve opening angle and lift amount of the cam profile for lower revolutions and the cam profile for higher revolutions can be set freely, depending on various requirements of individual internal combustion engines. In many cases, the cam profile for lower revolutions is used for smaller valve opening angles and lift amounts, whereas the cam profile for higher revolutions is used for larger valve opening angles and lift amounts.

If the displacement device is designed to displace the cam shaft in two steps, it is preferable that the amount of displacement can be adjusted. More preferably, The displacement device displaces the cam shaft in three steps, and continuous displacement is the most preferable. The displacement device may be operated hydraulically or electromagnetically and is not limited to any specific construction.

Examples of the arm is as follows.

1) A swing arm having one end which is pivotally supported by a rocker shaft, the other end which is provided with a valve engaging portion, and an intermediate portion which is provided with a roller mechanism equipped with the cam contacting element.
2) A swing arm having one end which is pivotally supported by a pivot, the other end which is provided with a valve engaging portion, and an intermediate portion which is provided with a roller mechanism equipped with the cam contacting contacting element.
3) A rocker arm having one end which is provided with a roller mechanism equipped with the cam contacting element, the other end which is provided with a valve engaging portion, and an intermediate portion which is pivotally supported by a rocker shaft.

An example of the seat is a semi-cylindrical inner seat which forms an inner surface of a semi-cylindrical recess.

An example of the cam contacting element is a semi-cylindrical body comprising a semi-cylindrical surface that slides on the seat and a substantially flat contacting surface that contacts the solid cam.

It is preferable that valve clearance is adjusted by preparing a plurality of cam contacting element gradually different in thickness (examples are shown in the manners a) and b) below), selecting and exchanging for a suitable one among them.

a) In the case where the cam contacting element is a semi-cylindrical body comprising a semi-cylindrical surface that slides on the seat and a substantially flat contacting surface that contacts the solid cam, semi-cylindrical surfaces of the plurality of cam contacting element may be gradually varied in radius one another so as the plurality of cam contacting element to be different in thickness.

In order to match the gradual difference in the radius of the semi-cylindrical surfaces, the seat has a generally V-shaped configuration defined by two intersecting cylindrical surfaces, or a generally V-shaped configuration defined by two intersecting planes, preferably.

b) In the case where the cam contacting element is a semi-cylindrical body comprising a semi-cylindrical surface that slides on the seat and a substantially flat contacting surface that contacts the solid cam, contacting surfaces of the plurality of cam contacting element may be gradually varied in height one another with the radius of semi-cylindrical surfaces thereof being constant so as the plurality of cam contacting element to be different in thickness.

In order for the cam contacting element to be prevented from moving longitudinally with respect to the seat, the following means can be taken.

i) Both ends of the seat are closed by a closing wall on which both end surfaces of the cam contacting element abut.
ii) An engaging recess formed in a longitudinally substantially central portion of the seat swingingly engages an engaging protrusion formed on a longitudinally substantially central portion of the cam contacting element.

Although the variable system of the present invention can be applied exclusively to intake valves or exhaust valves, it is preferable that the system be applied to both the intake valves and the exhaust valves.

Further objects of this invention will become evident upon an understanding of the illustrative embodiments described below. Various advantages not specifically referred to herein but within the scope of the instant invention will occur to one skilled in the art upon practice of the presently disclosed invention. The following examples and embodiments are illustrative and not seen to limit the scope of the invention.

DETAILED DESCRIPTION OF PREFERRED EMBODIMENTS

Preferred embodiments of the present invention will be described in detail hereinafter with reference to the accompanying drawings. Since the present invention can be applied to both intake and exhaust valves, the intake and exhaust valves will be referred to simply as valves in the following description.

Figure 1:
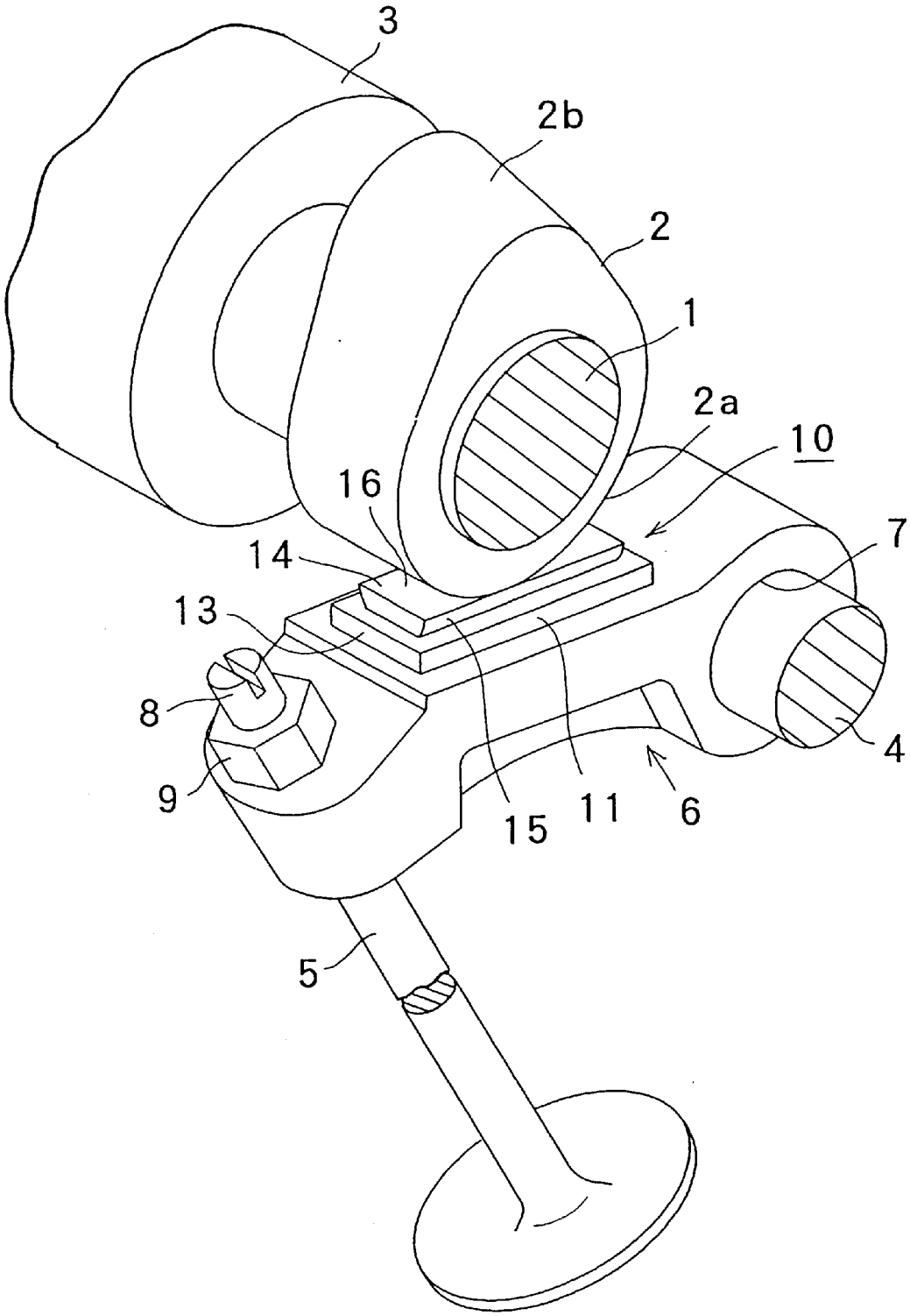
FIG. 1 is a perspective view showing a variable valve system of a first embodiment of the present invention.
Figure 2:
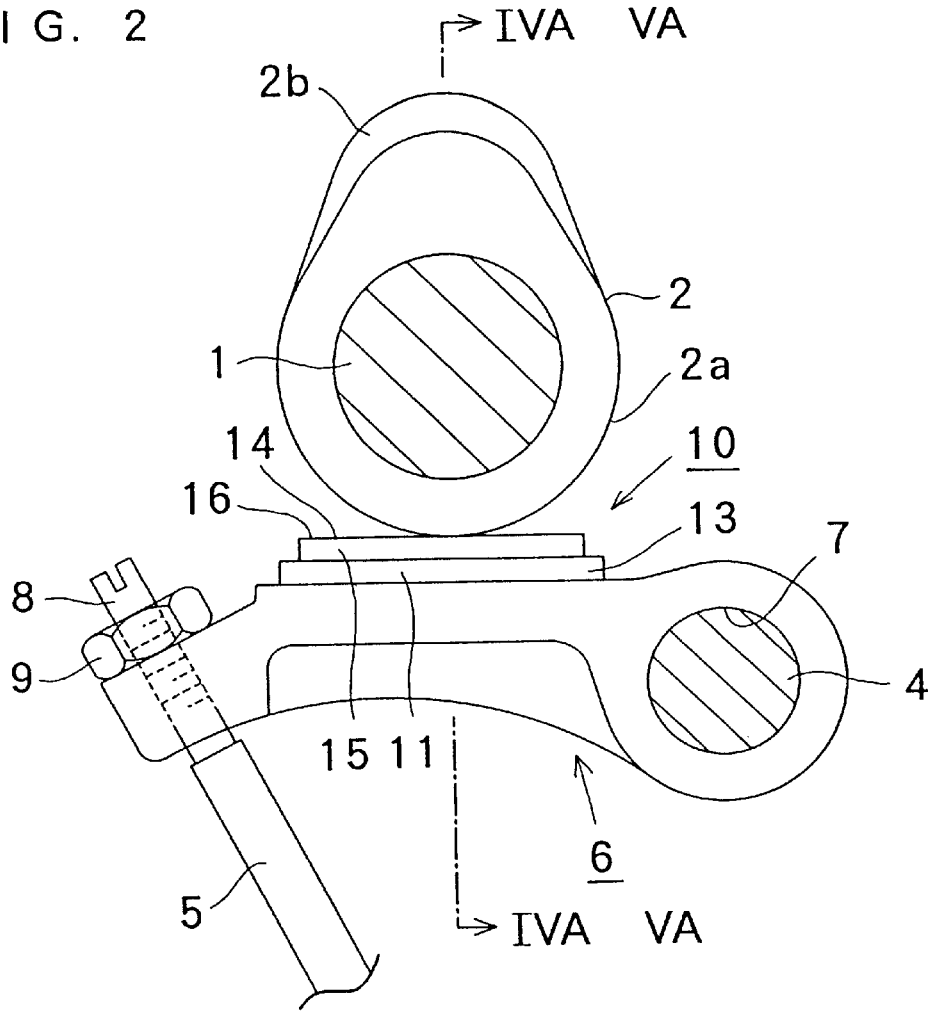
FIG. 2 is a front view of the variable valve system.
Figure 3:
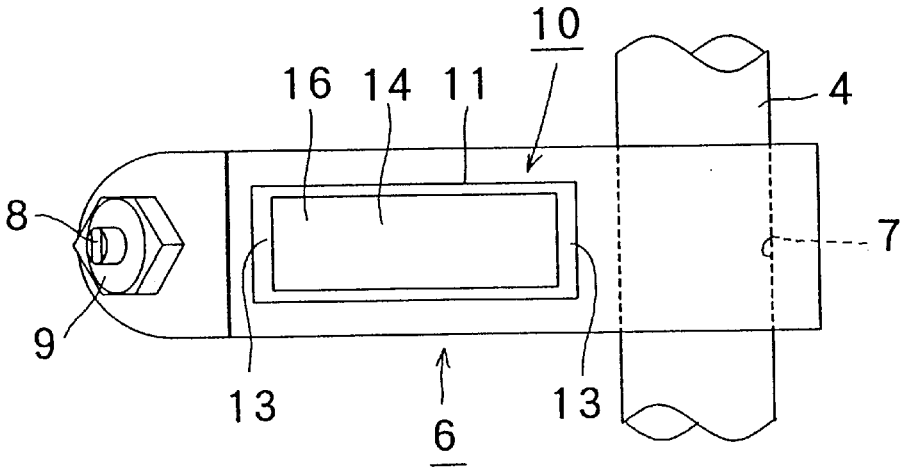
FIG. 3 is a plan view of the variable valve system.

FIGS. 1 through 7 show a variable valve system according to a first embodiment of the present invention. As shown in FIG. 1, a cam shaft 1 supports a solid cam 2 that continuously varies in cam profile along an axis of the cam shaft 1. More specifically, the solid cam 2 has a cross-sectional area that is enlarged in the right-to-left direction of FIG. 1. That is, the cam profile as shown on the right side of the figure is used for lower revolutions of an internal combustion engine, whereas the cam profile as shown on the left side is used for higher revolutions of the internal combustion engine. The solid cam 2 includes a base circle portion 2*a* and a nose portion 2*b*. For the entire range from lower revolutions to higher revolutions, the base circle portion 2*a* has a constant radius, i.e., a cylindrical surface with no inclination. However, the nose portion 2*b* inclines like a cone surface, such that the cam profile for lower revolutions provides smaller valve opening angles and lift amounts, and that the cam profile for higher revolutions provides larger valve opening angles and lift amounts.

A displacement device 3 for continuously displacing the cam shaft 1 is attached to one end thereof. The displacement device 3 axially displaces the cam shaft 1, depending on operating conditions of the internal combustion engine such as engine revolution or the like. The displacement device 3 has a guide portion into which the cam shaft 1 is spline-fitted, and a driving source for hydraulically driving the cam shaft 1 (both not shown). The displacement device 3 is controlled by a control unit (not shown) such as a microcomputer that operates based on sensors for detecting engine revolution, throttle opening degree, etc.

A rocker shaft 4 is arranged obliquely below the cam shaft 1. The rocker shaft 4 has a swing arm 6 pivotally supported thereon. The swing arm 6 swings in accordance with the cam profile of the solid cam 2, thereby opening and closing a valve 5. The swing arm 6 has at the right end thereof a through hole 7 through which the rocker shaft 4 extends, and at the left end thereof a valve pressing portion that is provided with an externally threaded pin 8 and a fastening nut 9 for the pin 8. Furthermore, there is formed a follow-up contacting mechanism 10 on an upper center surface of the swing arm 6. The follow-up contacting mechanism 10 is constructed as follows.

The swing arm 6 has on the upper center surface thereof a protrusion 11 extending in the direction perpendicular to an axis of the solid cam 2. A semi-cylindrical inner seat 12, which forms an inner surface of a semi-cylindrical body, is formed in the protrusion 11 along its length. Both ends of the semi-cylindrical inner seat 12 are closed by a closing wall 13. A semi-cylindrical cam contacting element 14 is fitted into the semi-cylindrical inner seat 12 such that the former slidably rolls on the latter. The cam contacting element 14 is a semi-cylindrical body having a semi-cylindrical surface 15 that slides contacts the semi-cylindrical inner seat 12 and a flat contacting surface 16 that contacts the solid cam 2. The cam contacting element 14 slides slightly along the semi-cylindrical inner seat 12 in order to follow changes in inclination of the contacting surface 16 resulting from rotation of the solid cam 2.

The radius of the semi-cylindrical inner seat 12 is slightly larger than that of the semi-cylindrical surface 15. Accordingly, when the cam contacting element 14 slides on the semi-cylindrical inner seat 12, the semi-cylindrical surface 15 slidably contacts a substantially central portion of the semi-cylindrical inner seat 12. Both ends of the cam contacting element 14 abut on the closing wall 13, so that the cam contacting element 14 is prevented from moving longitudinally with respect to the semi-cylindrical inner seat 12.

The operation of the variable valve system according to the present embodiment will be described hereinafter.

Figure 4A:
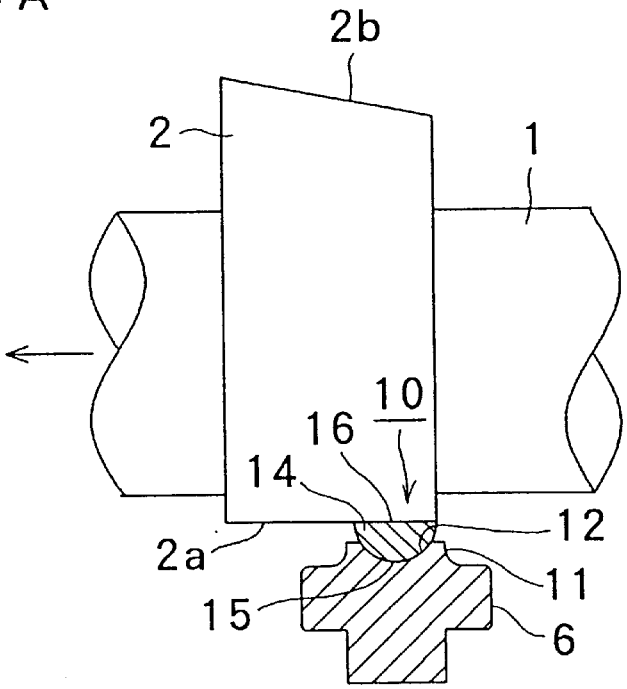
FIG. 4A is a sectional view taken along line IVA—IVA of FIG. 2, where a base circle portion for lower revolutions of an internal combustion engine is in contact with a follow-up contacting element.
Figure 4B:
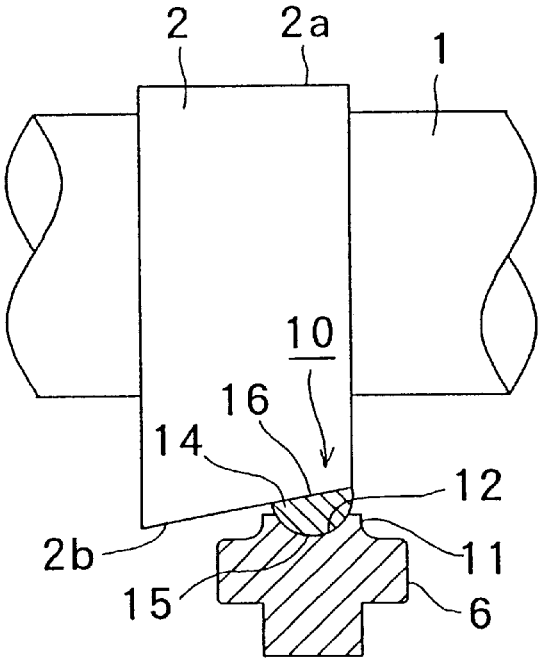
FIG. 4B is a sectional view of the variable valve system, where a nose portion is shifted from the state as shown in FIG. 4A and in contact with the cam contacting element.

For lower revolutions of the internal combustion engine, the displacement device 3 displaces the cam shaft 1 to the left, so that the cam contacting element 14 cooperates with the cam profile for lower revolutions, which is located on the right side of the solid cam 2 as viewed in FIGS. 4A and 4B. As shown in FIG. 4A, when the base circle portion 2*a* and the contacting surface 16 of the cam contacting element 14 come into contact with each other, they define a tangential line that is parallel to the axis of the solid cam 2. That is, the contacting surface 16 contacts the base circle portion 2*a* without inclining with respect to the upper surface of the swing arm 6. As shown in FIG. 4B, when the nose portion 2*b* and the contacting surface 16 come into contact with each other, they define a tangential line that inclines with respect to the axis of the solid cam 2 by a predetermined angle. That is, the cam contacting element 14 slidably rolls by an amount corresponding to the predetermined angle, thus bringing the contacting surface 16 smoothly into contact with the nose portion 2*b*.

Thus, every time the solid cam 2 rotates, the cam contacting element 14 slides slightly and comes into contact with the solid cam 2, while following changes in inclination of the tangential line, and it is appropriately pressed against the nose portion 2*b*. Thereby the swing arm 6 swings in accordance with the cam profile for lower revolutions, thus opening and closing the intake and exhaust valves 5 at a relatively small valve opening angle with a relatively small lift amount as indicated by a curved line L of FIG. 6. This results in an increase in torque for lower vehicle speeds as well as a substantial reduction in fuel consumption.

Figure 5A:
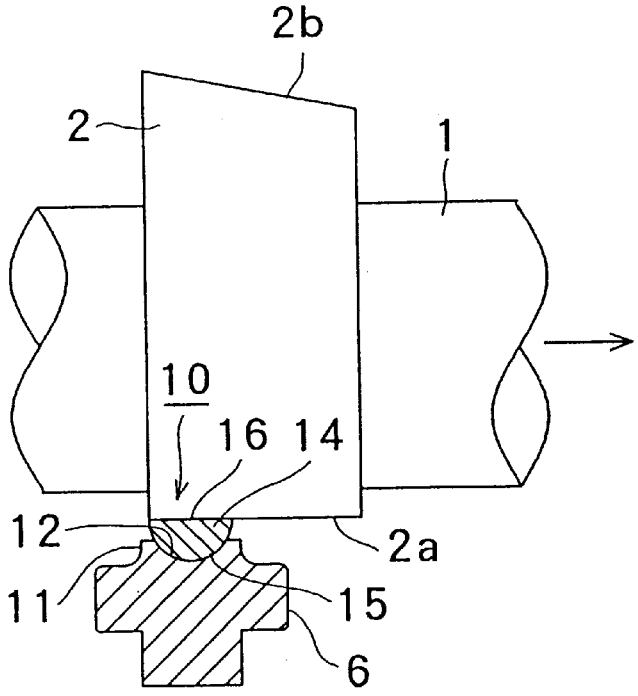
FIG. 5A is a sectional view taken along line VA—VA of FIG. 2, where the base circle portion for higher revolutions of the internal combustion engine is in contact with the cam contacting element.
Figure 5B:
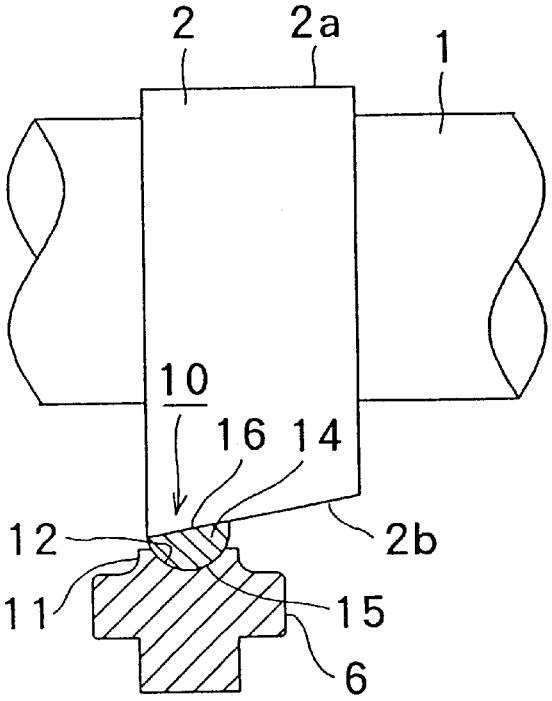
FIG. 5B is a sectional view of the variable valve system, where the nose portion is shifted from the state as shown in FIG. 5A and in contact with the cam contacting element.
Figure 6:
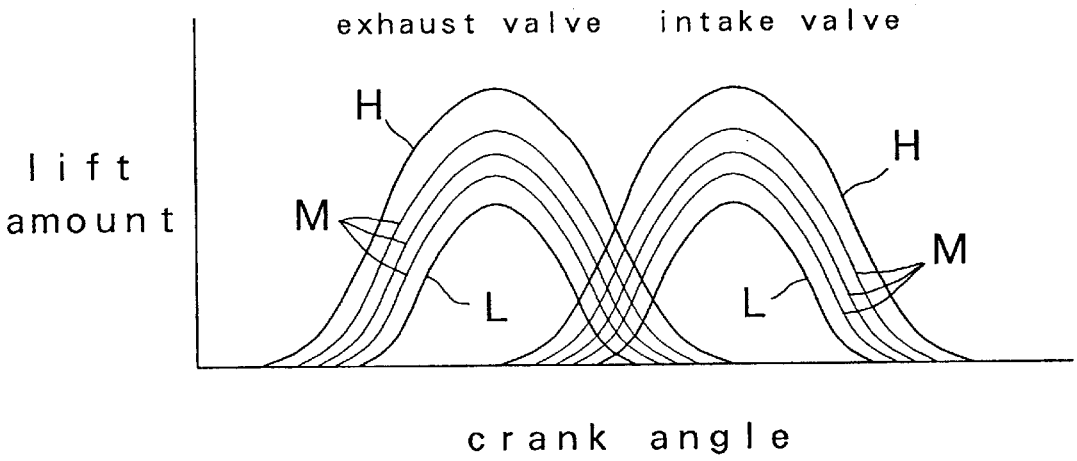
FIG. 6 is a graph representing the relationship between valve timing and lift amount of the variable valve system of the first embodiment.

For higher revolutions of the internal combustion engine, the displacement device 3 displaces the cam shaft 1 to the right, so that the cam contacting element 14 cooperates with the cam profile for higher revolutions, which is located on the left side of the solid cam 2 as viewed in FIGS. 5A and 5B. As shown in FIGS. 5A and 5B, every time the solid cam 2 rotates, the cam contacting element 14 slides once and comes into contact with the solid cam 2, while following changes in inclination of the tangential line, and it is appropriately pressed against the nose portion 2*b*. Thereby the swing arm 6 swings in accordance with the cam profile for higher revolutions, thus opening and closing the valve 5 at a relatively large valve opening angle with a relatively large lift amount as indicated by a curved line H of FIG. 6. This results in an increase in flow rate of intake air as well as an increase in high speed outputs.

For intermediate revolutions between lower and higher revolutions, the displacement device 3 continuously displaces the cam shaft 1 depending on a variety of operating conditions such as engine revolution, throttle opening degree, etc., so that the cam contacting element 14 cooperates with a cam profile for intermediate revolutions. Thereby the swing arm 6 swings in accordance with the cam profile for intermediate revolutions, thus opening and closing the valve 5 at an intermediate valve opening angle with an intermediate lift amount. This results in a fairly appropriate torque and outputs corresponding to the operating conditions.

Figure 7:
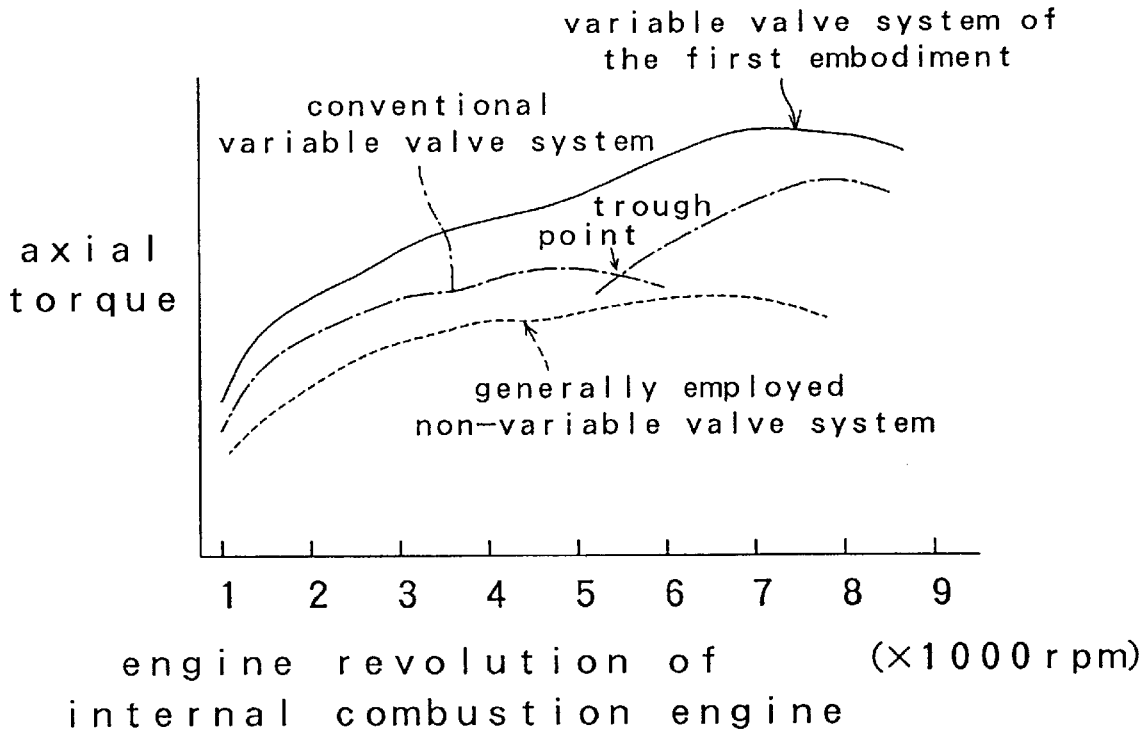
FIG. 7 is a graph for comparing torque characteristics of the variable valve system of the first embodiment with those of a conventional and a generally employed valve systems.

As described hitherto, the variable valve system in this embodiment achieves fine control corresponding to the respective operating conditions of the internal combustion engine by changing the valve timing and lift amount continuously over the entire range from lower revolutions to higher revolutions. As a result, various engine characteristics including torque, outputs, fuel consumption and cleanliness of exhaust gas can be improved to the greatest possible extent. FIG. 7 shows a graph representing torque characteristics of the internal combustion engine of this embodiment. Unlike the aforementioned conventional variable valve system as indicated by the dashed line, the torque achieved by this embodiment as indicated by a solid line continues to increase over the entire revolution range without generating any single trough point. Although there may be a slight difference depending on respective setting conditions, it is considered that the variable valve system of this embodiment can reduce fuel consumption by a maximum of 15 to 20%.

The valve timing and lift amount can be changed smoothly and quietly by displacing the cam shaft 1. In addition, the valve system requires only one solid cam 2 and one swing arm 6 for each valve 5, thus achieving simplification and compactness of the overall construction.

Figure 8:
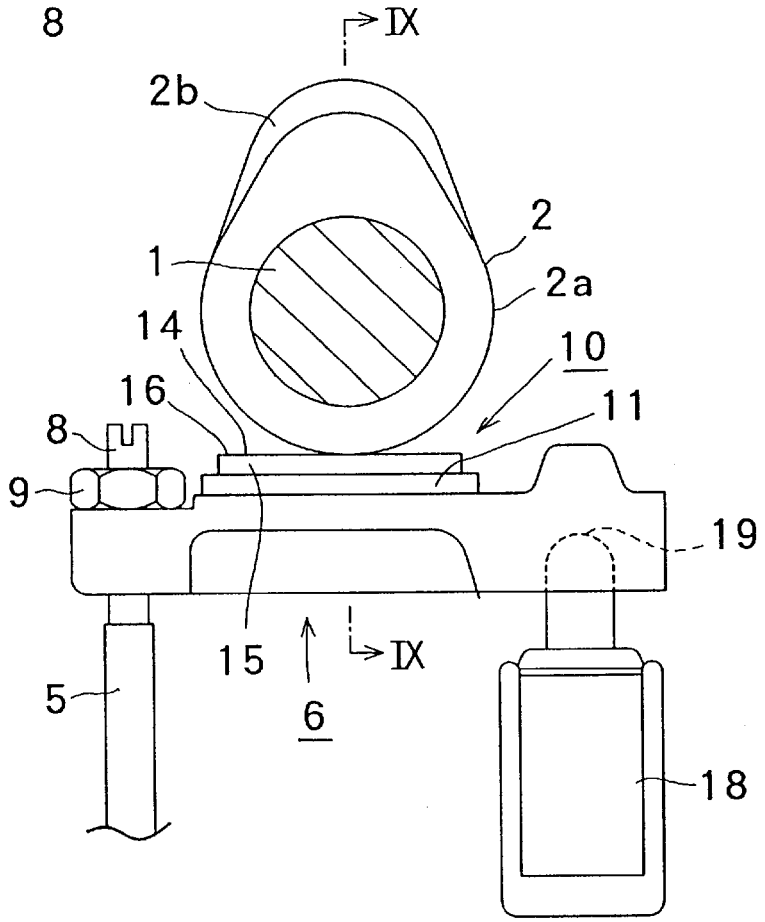
FIG. 8 is a front view of the variable valve system according to a second embodiment of the present invention.
Figure 9:
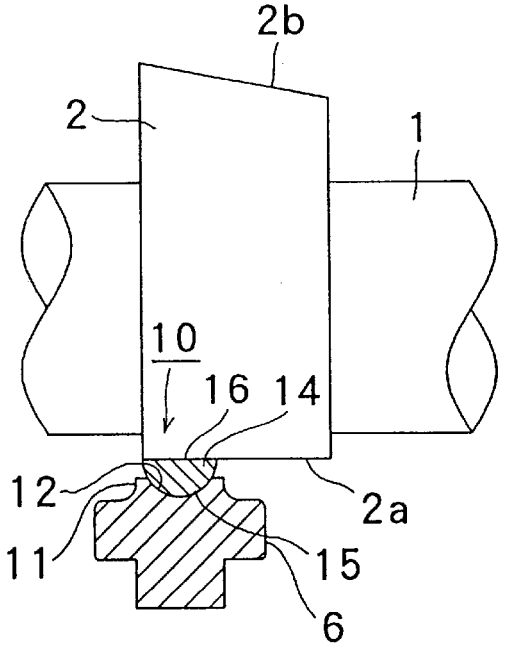
FIG. 9 is a sectional view taken along line IX—IX of FIG. 8.

A second embodiment of the variable valve system as shown in FIGS. 8 and 9 is similar to the first embodiment except that the right end of the swing arm 6 is pivotally supported by a pivot 19 of a hydraulic adjuster 18.

Figure 10:
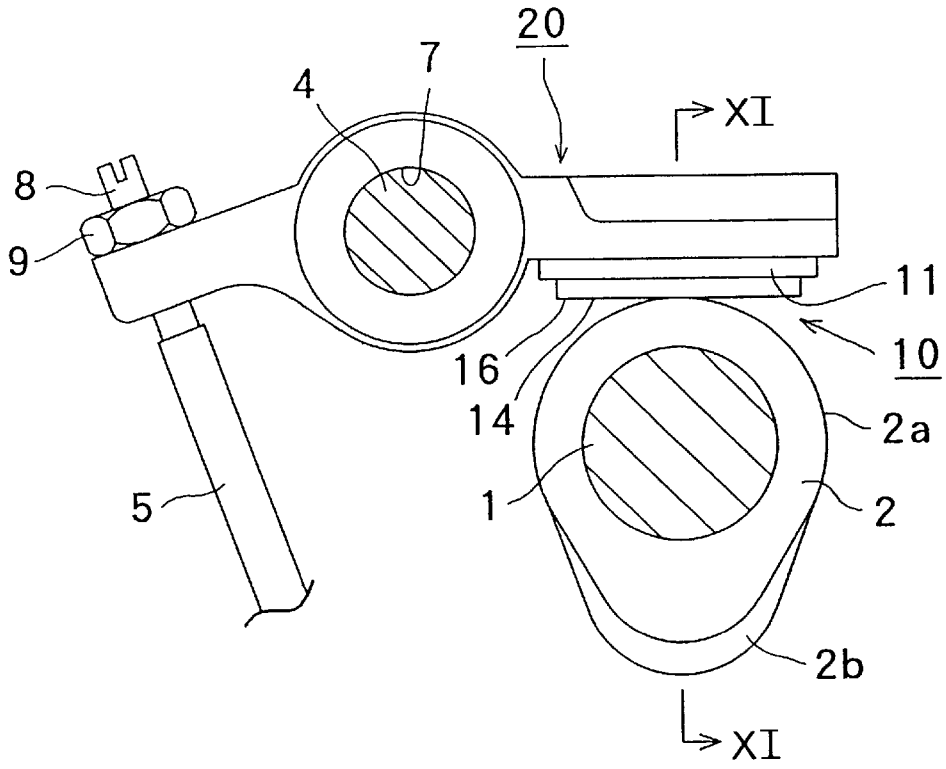
FIG. 10 is a front view of the variable valve system according to a third embodiment of the present invention.
Figure 11:
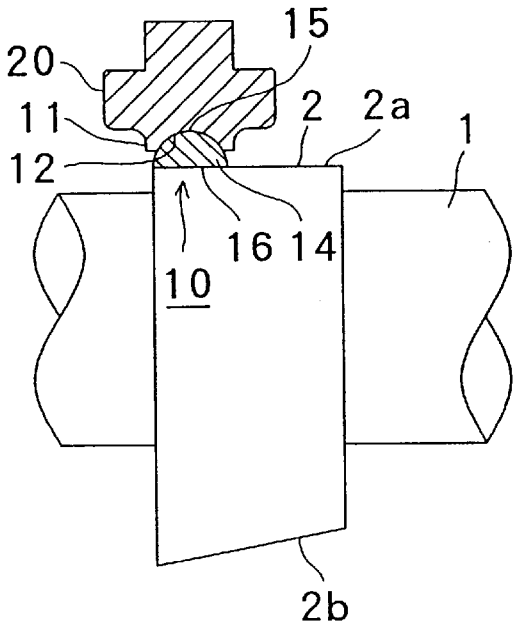
FIG. 11 is a sectional view taken along line XI—XI of FIG. 10.

A third embodiment of the variable valve system as shown in FIGS. 10 and 11 is similar to the first embodiment except that the swing arm 6 is replaced by a rocker arm 20. The rocker arm 20 has a cam contacting mechanism 10 on a lower surface of the right end thereof. The rocker arm 20 has at the left end thereof a valve engaging portion having the externally threaded pin 8 and the fastening nut 9 for the pin 8. Furthermore, there is formed a through hole 7 for accommodating the rocker shaft 4 in an intermediate portion of the rocker arm 20. The cam shaft 1 and the solid cam 2 are provided under the follow-up contacting mechanism 10. The rocker arm 20 operates substantially in the same manner as the swing arm 6 of the first embodiment, except that the rocker arm 20 swings like a seesaw.

The second and third embodiments of the present invention achieve substantially the same advantageous effects as the first embodiment does.

It is to be understood that the construction of the present invention is not limited to those described above. It is possible to modify the construction to such an extent that the resultant construction does not deviate from the scope of the present invention, for example, as follows.

(1) The cam shaft 1 may be displaced stepwise.

(2) The construction or control logic of the displacement device 3 may be suitably changed.

Figure 12:
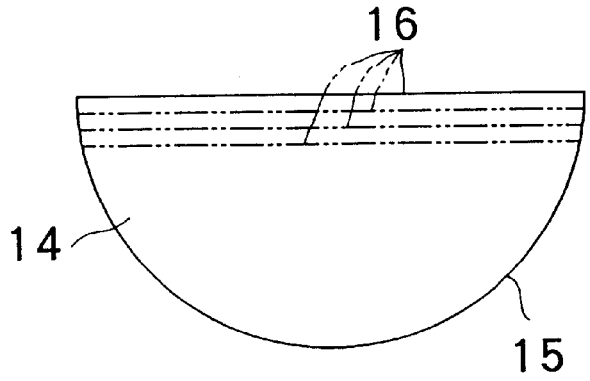
FIG. 12 is an end view showing a plurality of cam contacting element which are gradually different in thickness one another.
Figure 13:
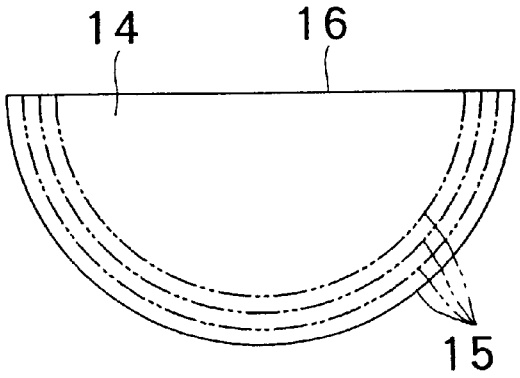
FIG. 13 is an end view showing another plurality of cam contacting element which are gradually different in thickness one another.
Figure 14:
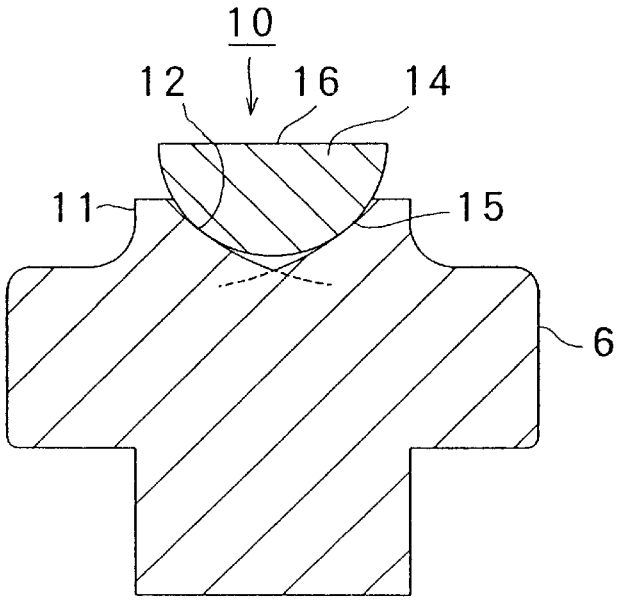
FIG. 14 is a sectional view of a modified seat.
Figure 15:
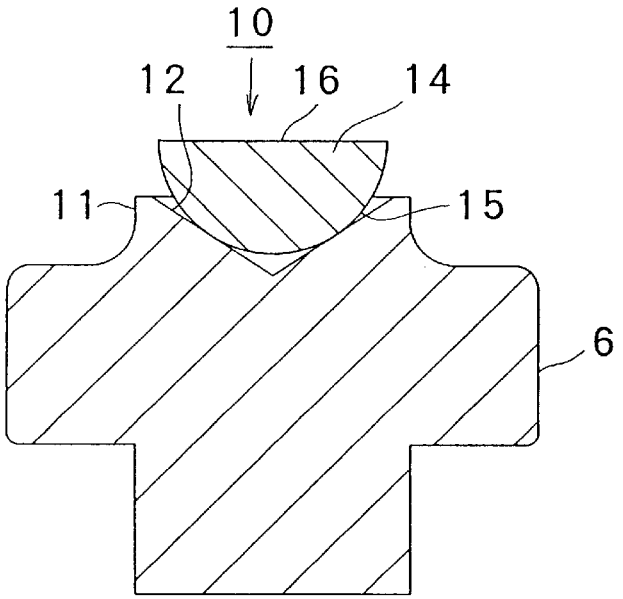
FIG. 15 is a sectional view of another modified seat.

(3) It may be possible to adjust valve clearance by preparing a plurality of cam contacting element 14 gradually different in thickness one another, as indicated by solid and double dashed lines of FIGS. 12 and 13, selecting and exchanging for a suitable one among them. As shown in FIG. 13, if semi-cylindrical surfaces 15 of the plurality of cam contacting element 14 are gradually varied in radius one another so as the plurality of cam contacting element 14 to be different in thickness, it is preferable that the semi-cylindrical inner seat 12 has a generally V-shaped configuration defined by two intersecting cylindrical surfaces as shown in FIG. 14, or a generally V-shaped configuration defined by two intersecting planes as shown in FIG. 15, in order to match the gradual difference.

Figure 16:
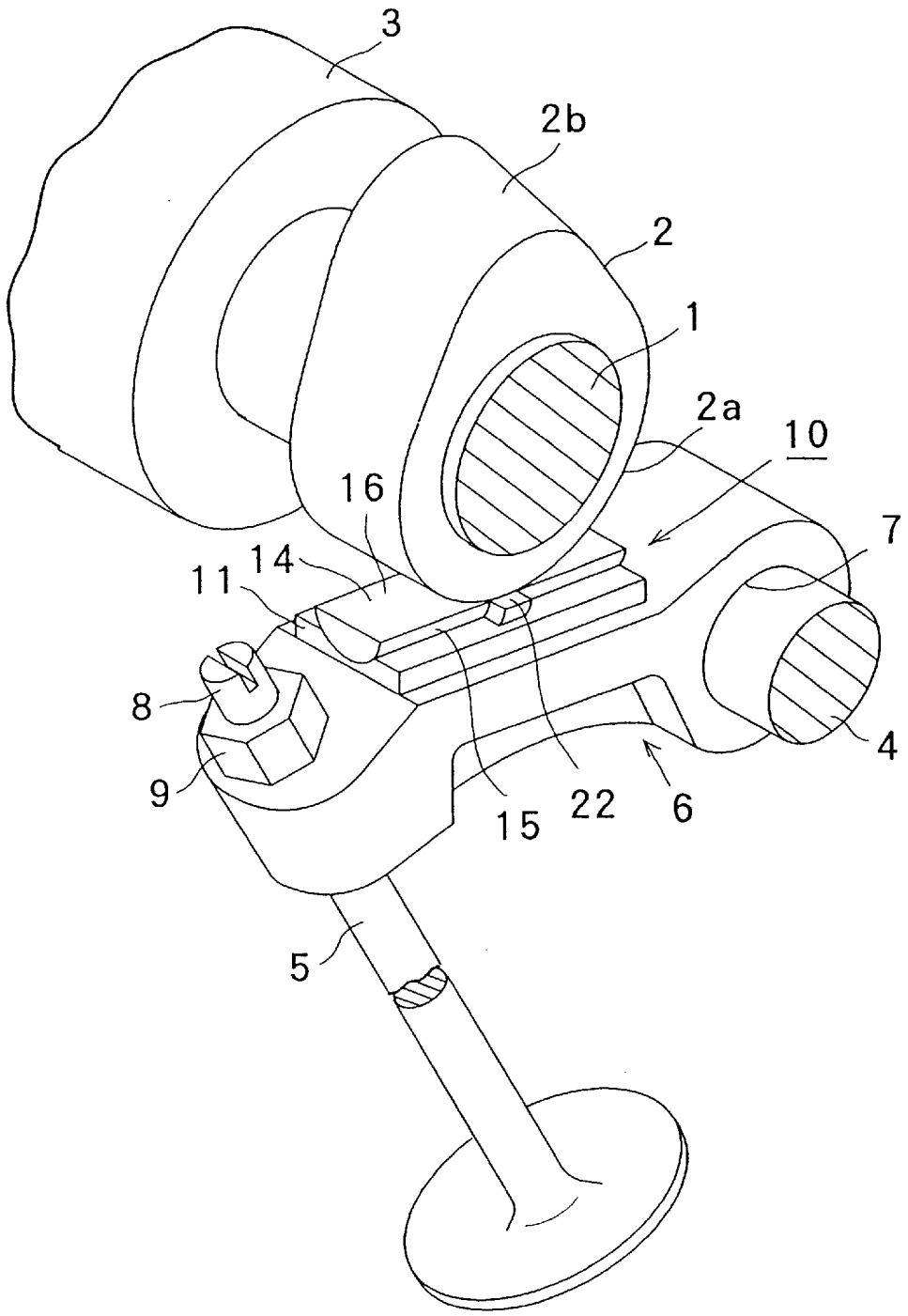
FIG. 16 is a perspective view showing another example of preventing the cam contacting element from moving longitudinally.
Figure 17:
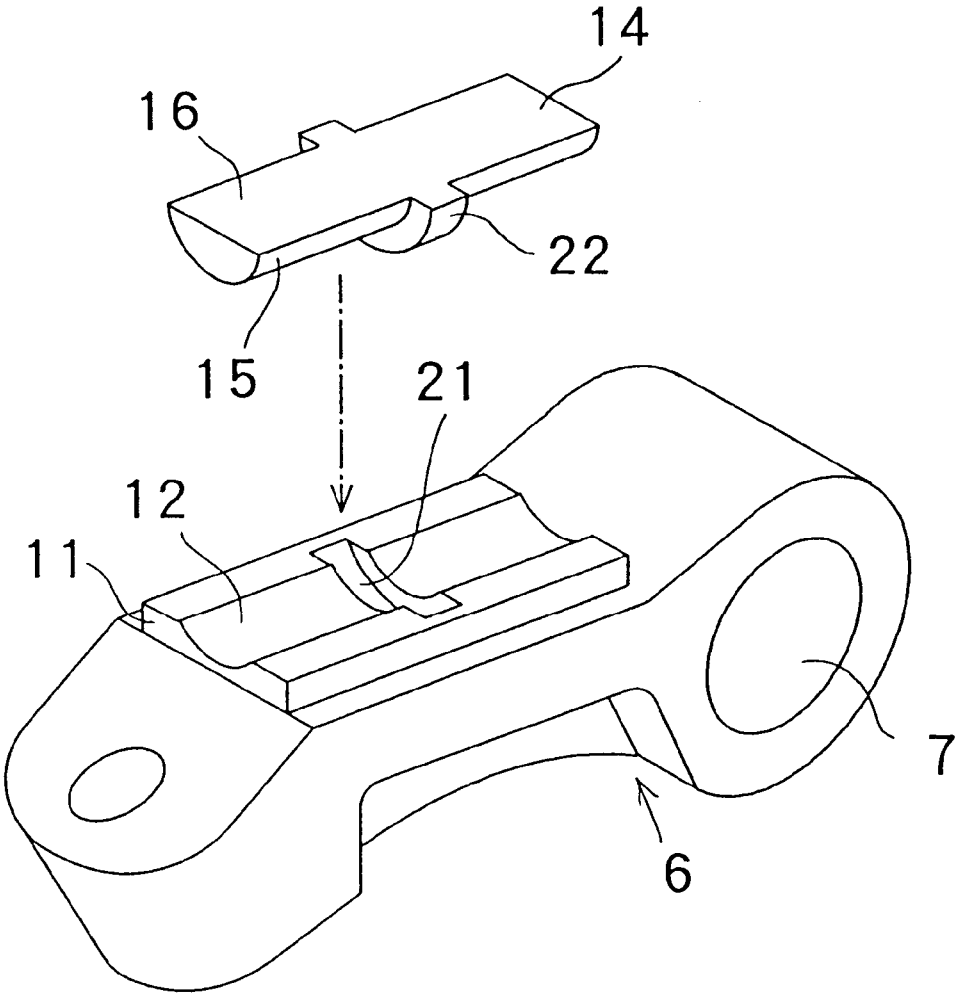
FIG. 17 is a perspective exploded view of FIG. 16.
Figure 18:
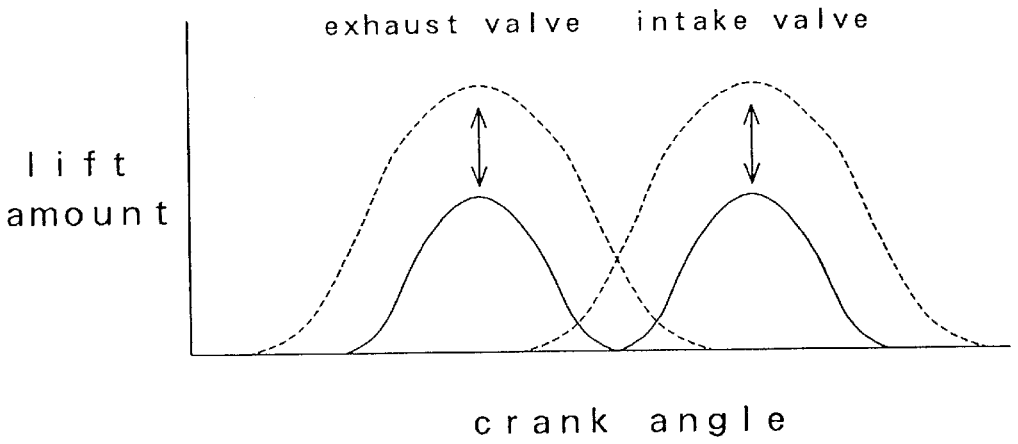
FIG. 18 PRIOR ART
FIG. 18 is a graph representing the relationship between valve timing and lift amount of a conventional variable valve system.
Figure 19:
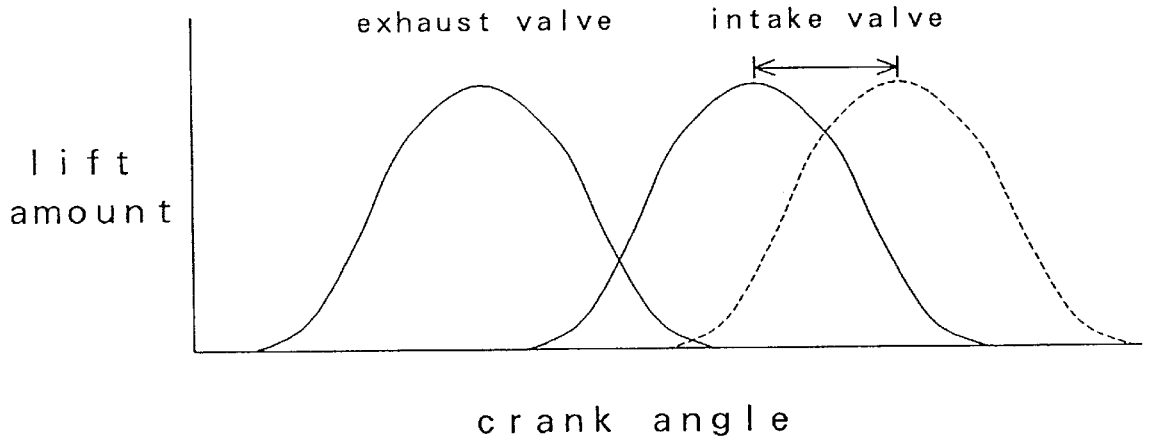
FIG. 19 PRIOR ART
FIG. 19 is a graph representing the relationship between valve timing and lift amount of another conventional variable valve system.

(4) As shown in FIGS. 16 and 17, the closing wall 13 as used in the first embodiment may be replaced by an engaging recess 21 and a fan-shaped engaging protrusion 22. The engaging recess 21 is formed in a longitudinally substantially central portion of the semi-cylindrical inner seat 12, whereas the engaging protrusion 22 is formed on a longitudinally substantially central portion of the semi-cylindrical surface 15 of the cam contacting element 14. The engaging protrusion 22 swingingly engages the engaging recess 21, thus preventing the cam contacting element 14 from moving longitudinally with respect to the semi-cylindrical inner seat 12. Accordingly, both ends of the semi-cylindrical inner seat 12 are not closed, so that both ends of the cam element 14 are visible from the outside.

This construction enables the semi-cylindrical inner seat 12 to be processed with ease and precision, because it does not have the closing wall 13, which may become an obstacle in processing the semi-cylindrical inner seat 12. An inner bottom surface of the engaging recess 21 may take any shape if the engaging recess 21 is deep enough to prevent the engaging protrusion 22 from contacting the inner bottom surface. That is, it does not make any difference whether the inner bottom surface of the engaging recess 21 is flat or curved. Therefore the engaging recess 21 can be processed easily. It is necessary to process inner side surfaces of the engaging recess 21 with high precision because they slidably contact the engaging protrusion 21. However, this causes no problem at all because the inner side surfaces of the engaging recess 21 can be polished easily with high precision. The engaging protrusion 22 may not necessarily take the shape of a fan. Furthermore, the absence of the closing wall 13 allows the longitudinal dimension of the contacting surface 16 for the solid cam 2 to be maximized. Therefore the height of the nose portion 2*b* of the solid cam 2 can be increased, whereby the valve lift amount can be set to the greatest possible value.

(5) The contacting surface 16 may be flat or curved in a manner that the longitudinally central portion thereof is slightly raised.

While the present invention has been described with reference to preferred embodiments thereof, it is to be understood that the invention is not limited to the disclosed embodiment or construction. To the contrary, the invention is intended to cover various modifications and equivalent arrangements included within the spirit and scope of the appended claims.

What is claimed is:

1. A variable valve system comprising:

a cam having a cam profile that varies in an axial direction of a camshaft;

a moveable arm disposed to transmit opening and closing force to a valve in accordance with said cam profile of said cam;

said arm including a cam follower mechanism having a cam contacting element and a seat;

said cam contacting element foaming a semi-cylindrical body defining a semi-cylindrical seating surface and a generally flat cam contacting surface;

a displacement device to selectively displace said cam axially relative to said cam contacting surface;

wherein said cam contacting element is slidably seated in said seat so that said cam contacting element contacts said cam at said cam contacting surface and moves to follow changes in said cam profile.

2. A variable valve system according to claim 1, wherein said arm is a swing arm having one end which is pivotally supported by a rocker shaft, the other end which is provided with a valve engaging portion, and an intermediate portion which is provided with a roller mechanism equipped with said cam contacting element.

3. A variable valve system according to claim 1, wherein said arm is a swing arm having one end which is pivotally supported by a pivot, the other end which is provided with a valve engaging portion, and an intermediate portion which is provided with a roller mechanism equipped with said cam contacting element.

4. A variable valve system according to claim 1, wherein said arm is a rocker arm having one end which is provided with a roller mechanism equipped with said cam contacting element, the other end which is provided with a valve engaging portion, and an intermediate portion which is pivotally supported by a rocker shaft.

5. A variable valve system according to claim 1, wherein said seat is a semi-cylindrical inner seat which forms a semi-cylindrical recess.

6. A variable valve system according to claim 1, wherein valve clearance is adjusted by preparing a plurality of cam contacting elements each having a predetermined thickness arranged to form a set of cam contacting elements of graduated thicknesses, and installing a selected one of said plurality of cam contacting elements in said seat.

7. A variable valve system according to claim 1, comprising a plurality of cam contacting elements having a plurality of predetermined thicknesses to form a set of cam contacting elements of graduated thicknesses, whereby valve clearance can be adjusted by installing a selected one of said plurality of cam contacting elements in said seat.

8. A variable valve system according to claim 7, wherein each of said plurality of cam contacting elements has a radius of predetermined dimension to form a set of cam contacting elements of graduated radii.

9. A variable valve system according to claim 7, wherein each of said cam contacting elements has a generally equal radius.

10. A variable valve system according to claim 1, wherein said seat forms a generally V-shaped recess to seat said cam contacting element therein.

11. A variable valve system in accordance with claim 10, wherein the V-shaped recess is formed by a plurality of intersecting generally planar surfaces.

12. A variable valve system according to claim 10, wherein the V-shaped recess is formed by a plurality of intersecting generally curved surfaces.

13. A variable valve system according to claim 1, wherein said cam contacting element has two end surfaces, and said seat forms a recess having two ends each closed by an end wall, said end walls to limit movement of said cam contacting element end surfaces.

14. A variable valve system according to claim 1, wherein said cam contacting element has a longitudinal extent and an engaging protrusion formed along said longitudinal extent on said seating surface, and said seat defines an engaging recess formed to receive said engaging protrusion to limit longitudinal movement of said cam contacting element.

15. A variable valve system according to claim 14, wherein said engaging protrusion is formed on a longitudinally substantially central portion of said seating surface, and said engaging recess is formed in a longitudinally substantially central portion of said seat.

16. A variable valve system according to claim 1, wherein said cam profile varies continuously in an axial direction of the camshaft.

17. A variable valve system according to claim 1, wherein said cam contacting element slides to follow changes in said cam profile.

18. A variable valve system according to claim 1, wherein said cam contacting element has a longitudinal extent and said cam contacting element is prevented from moving longitudinally relative to said seat.

* * * * *